US008259968B2

(12) United States Patent
Jiang et al.

(10) Patent No.: US 8,259,968 B2
(45) **Date of Patent: *Sep. 4, 2012**

(54) THERMOACOUSTIC DEVICE

(75) Inventors: Kai-Li Jiang, Beijing (CN); Yuan Chao Yang, Beijing (CN); Zhuo Chen, Beijing (CN); Lin Xiao, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 306 days.

This patent is subject to a terminal disclaimer.

(21) Appl. No.: 12/590,291

(22) Filed: Nov. 5, 2009

(65) Prior Publication Data

US 2010/0054504 A1 Mar. 4, 2010

Related U.S. Application Data

(63) Continuation-in-part of application No. 12/387,089, filed on Apr. 28, 2009, now Pat. No. 8,068,624.

(30) Foreign Application Priority Data

| | | |
|---|---|---|
| Apr. 28, 2008 | (CN) | 2008 1 0066693 |
| Jun. 4, 2008 | (CN) | 2008 1 0067586 |
| Jun. 4, 2008 | (CN) | 2008 1 0067589 |
| Jun. 4, 2008 | (CN) | 2008 1 0067638 |
| Jun. 18, 2008 | (CN) | 2008 1 0067905 |
| Jun. 18, 2008 | (CN) | 2008 1 0067906 |
| Jun. 18, 2008 | (CN) | 2008 1 0067907 |
| Jun. 18, 2008 | (CN) | 2008 1 0067908 |
| Dec. 5, 2008 | (CN) | 2008 1 0218230 |
| Dec. 5, 2008 | (CN) | 2008 1 0218232 |
| Feb. 27, 2009 | (CN) | 2009 1 0105808 |

(51) Int. Cl.
*H04R 25/00* (2006.01)

(52) U.S. Cl. ..... 381/164; 381/166

(58) Field of Classification Search ..... 381/164, 381/166

See application file for complete search history.

(56) References Cited

U.S. PATENT DOCUMENTS

| | | | | |
|---|---|---|---|---|
| 1,407,726 | A * | 2/1922 | Browne et al. | 381/164 |
| 1,528,774 | A | 3/1925 | Kranz | |
| 4,002,897 | A | 1/1977 | Kleinman et al. | |
| 4,334,321 | A | 6/1982 | Edelman | |
| 4,503,564 | A | 3/1985 | Edelman et al. | |

(Continued)

FOREIGN PATENT DOCUMENTS

| | | |
|---|---|---|
| CN | 2302622 | 12/1998 |

(Continued)

OTHER PUBLICATIONS

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

(Continued)

*Primary Examiner* — Curtis Kuntz
*Assistant Examiner* — Ryan Robinson
(74) *Attorney, Agent, or Firm* — Altis Law Group, Inc.

(57) ABSTRACT

A thermoacoustic device. The thermoacoustic includes a carbon nanotube structure. The carbon nanotube structure is at least partly in contact with a liquid medium. The thermoacoustic device is capable of causing a thermoacoustic effect in the liquid medium.

29 Claims, 13 Drawing Sheets

U.S. PATENT DOCUMENTS

| | | | | |
|---|---|---|---|---|
| 4,641,377 | A | 2/1987 | Rush et al. | |
| 4,766,607 | A | 8/1988 | Feldman | |
| 5,694,477 | A | 12/1997 | Kole | |
| 6,473,625 | B1 | 10/2002 | Williams et al. | |
| 6,777,637 | B2 | 8/2004 | Nakayama et al. | |
| 6,803,116 | B2 | 10/2004 | Ikeda | |
| 6,808,746 | B1 | 10/2004 | Dai et al. | |
| 6,921,575 | B2 | 7/2005 | Horiuchi et al. | |
| 7,045,108 | B2 | 5/2006 | Jiang et al. | |
| 7,393,428 | B2 | 7/2008 | Huang et al. | |
| 7,474,590 | B2 * | 1/2009 | Watabe et al. | 367/140 |
| 7,723,684 | B1 | 5/2010 | Haddon et al. | |
| 7,799,163 | B1 | 9/2010 | Mau et al. | |
| 7,881,157 | B2 * | 2/2011 | Watabe et al. | 367/140 |
| 2001/0005272 | A1 | 6/2001 | Buchholz | |
| 2001/0048256 | A1 | 12/2001 | Miyazaki et al. | |
| 2002/0076070 | A1 | 6/2002 | Yoshikawa et al. | |
| 2003/0038925 | A1 | 2/2003 | Choi | |
| 2003/0165249 | A1 | 9/2003 | Higuchi | |
| 2004/0053780 | A1 | 3/2004 | Jiang et al. | |
| 2005/0040371 | A1 | 2/2005 | Watanabe et al. | |
| 2005/0201575 | A1 * | 9/2005 | Koshida et al. | 381/164 |
| 2006/0072770 | A1 | 4/2006 | Miyazaki | |
| 2006/0104451 | A1 | 5/2006 | Browning et al. | |
| 2006/0147081 | A1 | 7/2006 | Mango, III et al. | |
| 2006/0264717 | A1 | 11/2006 | Pesach et al. | |
| 2007/0145335 | A1 | 6/2007 | Anazawa | |
| 2007/0164632 | A1 | 7/2007 | Adachi et al. | |
| 2007/0166223 | A1 | 7/2007 | Jiang et al. | |
| 2007/0176498 | A1 | 8/2007 | Sugiura et al. | |
| 2008/0063860 | A1 | 3/2008 | Song et al. | |
| 2008/0095694 | A1 | 4/2008 | Nakayama et al. | |
| 2008/0170982 | A1 | 7/2008 | Zhang et al. | |
| 2008/0248235 | A1 | 10/2008 | Feng et al. | |
| 2008/0260188 | A1 | 10/2008 | Kim | |
| 2008/0299031 | A1 | 12/2008 | Liu et al. | |
| 2009/0016951 | A1 | 1/2009 | Kawabata et al. | |
| 2009/0028002 | A1 | 1/2009 | Sugiura et al. | |
| 2009/0045005 | A1 | 2/2009 | Byon et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |
| 2009/0196981 | A1 | 8/2009 | Liu et al. | |
| 2009/0232336 | A1 | 9/2009 | Pahl | |
| 2010/0054502 | A1 | 3/2010 | Miyachi | |
| 2010/0054507 | A1 | 3/2010 | Oh et al. | |
| 2010/0086166 | A1 | 4/2010 | Jiang et al. | |
| 2010/0166232 | A1 | 7/2010 | Liu et al. | |
| 2010/0233472 | A1 | 9/2010 | Liu et al. | |
| 2011/0171419 | A1 | 7/2011 | Li et al. | |

FOREIGN PATENT DOCUMENTS

| | | | |
|---|---|---|---|
| CN | 2425468 | | 3/2001 |
| CN | 1407392 | | 4/2003 |
| CN | 1443021 | | 9/2003 |
| CN | 1698400 | | 11/2005 |
| CN | 2779422 | Y | 5/2006 |
| CN | 1787696 | | 6/2006 |
| CN | 2787870 | Y | 6/2006 |
| CN | 2798479 | | 7/2006 |
| CN | 1821048 | A | 8/2006 |
| CN | 1821048 | A * | 8/2006 |
| CN | 1886820 | | 12/2006 |
| CN | 1944829 | | 4/2007 |
| CN | 1982209 | | 6/2007 |
| CN | 1997243 | | 7/2007 |
| CN | 101239712 | | 8/2008 |
| CN | 101284662 | | 10/2008 |
| CN | 201150134 | | 11/2008 |
| CN | 101314464 | | 12/2008 |
| CN | 101471213 | | 7/2009 |
| CN | 101715155 | | 5/2010 |
| CN | 101400198 | | 9/2010 |
| JP | 49-24593 | | 3/1974 |
| JP | 58-9822 | | 1/1983 |
| JP | 60-22900 | | 2/1985 |
| JP | 1-255398 | | 10/1989 |
| JP | 3-147497 | | 6/1991 |
| JP | 4-126489 | | 4/1992 |
| JP | 7-282961 | | 10/1995 |
| JP | 9-105788 | | 4/1997 |
| JP | 11-282473 | | 10/1999 |
| JP | 11-300274 | | 11/1999 |
| JP | 2001333493 | | 11/2001 |
| JP | 2002-186097 | | 6/2002 |
| JP | 2002-352940 | | 12/2002 |
| JP | 2003-154312 | | 5/2003 |
| JP | 2003198281 | | 7/2003 |
| JP | 2003-266399 | | 9/2003 |
| JP | 2003-319490 | | 11/2003 |
| JP | 2003-319491 | | 11/2003 |
| JP | 2003-332266 | | 11/2003 |
| JP | 20042103 | | 1/2004 |
| JP | 2004-107196 | | 4/2004 |
| JP | 2004229250 | | 8/2004 |
| JP | 2005-20315 | | 1/2005 |
| JP | 2005-51284 | | 2/2005 |
| JP | 2005-73197 | | 3/2005 |
| JP | 2005-97046 | | 4/2005 |
| JP | 2005189322 | | 7/2005 |
| JP | 2005-235672 | | 9/2005 |
| JP | 2005-318040 | | 11/2005 |
| JP | 2005-534515 | | 11/2005 |
| JP | 2005-341554 | | 12/2005 |
| JP | 2005333601 | | 12/2005 |
| JP | 2006-93932 | | 4/2006 |
| JP | 2006-180082 | | 7/2006 |
| JP | 2006-202770 | | 8/2006 |
| JP | 2006-217059 | | 8/2006 |
| JP | 2007-24688 | | 2/2007 |
| JP | 2007-54831 | | 3/2007 |
| JP | 2007-167118 | | 7/2007 |
| JP | 2007-174220 | | 7/2007 |
| JP | 2007-187976 | | 7/2007 |
| JP | 2007-196195 | | 8/2007 |
| JP | 2007-228299 | | 9/2007 |
| JP | 2007-527099 | | 9/2007 |
| JP | 2008-62644 | | 3/2008 |
| JP | 2008-101910 | | 5/2008 |
| JP | 2008-163535 | | 7/2008 |
| JP | 2008-269914 | | 11/2008 |
| JP | 2009-31031 | | 2/2009 |
| JP | 2009-91239 | | 4/2009 |
| JP | 2009-94074 | | 4/2009 |
| JP | 2009-146896 | | 7/2009 |
| JP | 2009-146898 | | 7/2009 |
| JP | 2009-164125 | | 7/2009 |
| JP | 2009-184907 | | 8/2009 |
| JP | 2009-184908 | | 8/2009 |
| KR | 10-0761548 | | 9/2007 |
| TW | 200740976 | | 11/2007 |
| TW | 200744399 | | 12/2007 |
| TW | 201029481 | | 8/2010 |
| WO | WO0073204 | | 12/2000 |
| WO | WO2004012932 | | 2/2004 |
| WO | WO2005120130 | | 12/2005 |
| WO | WO2007043837 | | 4/2007 |
| WO | WO2007052928 | | 5/2007 |
| WO | WO2007099975 | | 9/2007 |
| WO | WO2008/029451 | | 3/2008 |

OTHER PUBLICATIONS

Strutt John William, Rayleigh Baron, The Theory of Sound, 1926, pp. 226-235, vol. 2.

William Henry Preece, On Some Thermal Effects of Electric Currents, Proceedings of the Royal Society of London, 1879-1880, pp. 408-411, vol. 30.

H.D. Arnold, I.B. Crandall, The Thermophone as a Precision Source of Sound, Physical Review, 1917, pp. 22-38, vol. 10.

Kaili Jiang, Qunqing Li, Shoushan Fan, Spinning continuous carbon nanotube yarns, Nature, Oct. 24, 2002, pp. 801, vol. 419.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.
Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.
Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.
Swift Gregory W., Thermoacoustic Engines and Refrigerators, Physics Today, Jul. 1995, pp. 22-28, vol. 48.
W. Yi, L.Lu, Zhang Dianlin et al., Linear Specific Heat of Carbon Nanotubes, Physical Review B, Apr. 1, 1999, vol. 59, No. 14, R9015-9018.
Frank P. Incropera, David P. Dewitt et al., Fundamentals of Heat and Mass Transfer, 6th ed., 2007, pp. A-5, Wiley:Asia.
Zhuangchun Wu, Zhihong Chen, Xu Du et al.,Transparent, Conductive Carbon Nanotube Films, Science, Aug. 27, 2004, pp. 1273-1276, vol. 305.
P. De Lange, on Thermophones, Proceedings of the Royal Society of London. Series A, Apr. 1, 1915, pp. 239-241, vol. 91, No. 628.
Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, Vol-18.
Edward C. Wente, The Thermophone, Physical Review, 1922, pp. 333-345,vol. 19.
J.J.Hopfield, Spectra of Hydrogen, Nitrogen and Oxygen in the Extreme Ultraviolet, Physical Review, 1922, pp. 573-588,vol. 20.
Braun Ferdinand, Notiz uber Thermophonie, Ann. Der Physik, Apr. 1898, pp. 358-360,vol. 65.
Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.
Chen, Huxiong; Diebold, Gerald, "Chemical Generation of Acoustic Waves: A Giant Photoacoustic Effect", Nov. 10, 1995, Science, vol. 270, pp. 963-966.
Amos, S.W.; "Principles of Transistor Circuits"; 2000; Newnes-Butterworth-Heinemann; 9th ed.;p. 114.
Lin Xiao et al., "Flexible, stretchable, transparent carbon nanotube thin film loudspeakers" vol. 8, No. 12, pp. 4539-4545 ,2008.
Alexander Graham Bell, Selenium and the Photophone, Nature, Sep. 23, 1880, pp. 500-503.
Lee et al., Photosensitization of nonlinear scattering and photoacoustic emission from single-walled carbon nanotubes, Applied Physics Letters, 13, Mar. 2008, 92, 103122.
Silvanus P. Thompson, The Photophone, Nature, 23, Sep. 1880, vol. XXII, No. 569, pp. 481.

* cited by examiner

THERMOACOUSTIC DEVICE

CROSS-REFERENCE TO RELATED APPLICATIONS

This application claims all benefits accruing under 35 U.S.C. §119 from China Patent Application No. 200810218232.9, filed on Dec. 5, 2008 in the China Intellectual Property Office, the disclosure of which is incorporated herein by reference, and is a continuation-in-part of U.S. patent application Ser. No. 12/387,089, filed. Apr. 28, 2009, entitled, "THERMOACOUSTIC DEVICE". This application is also related to copending application Ser. No. 12/590,298 entitled, "ULTRASOUND ACOUSTIC DEVICE", filed Nov. 5, 2009.

BACKGROUND

1. Technical Field

The present disclosure relates to acoustic devices, particularly, to a thermoacoustic device in a liquid media.

2. Description of Related Art

Acoustic devices generally include a signal device and a speaker. Signals are transmitted from the signal device to the speaker. The speaker converts the electrical signals into sound. There are different types of speakers that can be categorized according to their working principle, such as electro-dynamic loudspeakers, electromagnetic loudspeakers, electrostatic loudspeakers, and piezoelectric loudspeakers. However, the various types ultimately use mechanical vibration to produce sound waves, in other words they all achieve "electro-mechanical-acoustic" conversion.

In a paper entitled "The Thermophone" by Edward C. WENTE, Phy. Rev, 1922, Vol. XIX, No. 4, p 333-345, and another paper entitled "On Some Thermal Effects of Electric Currents" by William Henry Preece, Proc. R. Soc. London, 1879-1880, Vol. 30, p 408-411, a thermoacoustic effect was proposed. Sound waves based on the thermoacoustic effect are generated by inputting an alternating current to a metal foil, wherein or metal foil acts as a thermoacoustic element. The thermoacoustic element has a low heat capacity and is thin, so that it can transmit heat to surrounding gas medium rapidly. When the alternating current passes through the thermoacoustic element, oscillating temperature is produced in the thermoacoustic element according to the alternating current. Heat wave excited by the alternating current is transmitted in the surrounding gas medium, and causes thermal expansions and contractions of the surrounding gas medium, and thus, a sound pressure is produced.

In another article, entitled "The thermophone as a precision source of sound" by H. D. Arnold and I. B. Crandall, Phys. Rev. 10, pp 22-38 (1917), a thermophone based on the thermoacoustic effect is disclosed. Referring to FIG. 13, a thermophone 100 in the article includes a platinum strip 102 and two terminal clamps 104. The two terminal clamps 104 are located apart from each other, and are electrically connected to the platinum strip 102. The platinum strip 102 having a thickness of 0.7 micrometers. Frequency response range and sound pressure of sound wave are closely related to the heat capacity per unit area of the platinum strip 102. The higher the heat capacity per unit area, the narrower the frequency response range and the weaker the sound pressure. It's very difficult to produce an extremely thin metal strip (e.g., platinum strip). For example, the platinum strip 102 has a heat capacity per unit area higher than $2\times10^{-4}$ J/cm$^2$*K. The highest frequency response of the platinum strip 102 is only $4\times10^3$ Hz, and the sound pressure produced by the platinum strip 102 is also too weak and is difficult to be heard by human. Further, the platinum strip 102 can only generate sound waves in a gas medium such as air, although it could be very useful to produce sound waves in different mediums.

What is needed, therefore, is to provide a thermoacoustic device having a wider frequency response range and a higher sound pressure, and able to propagate sound in more than one medium.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
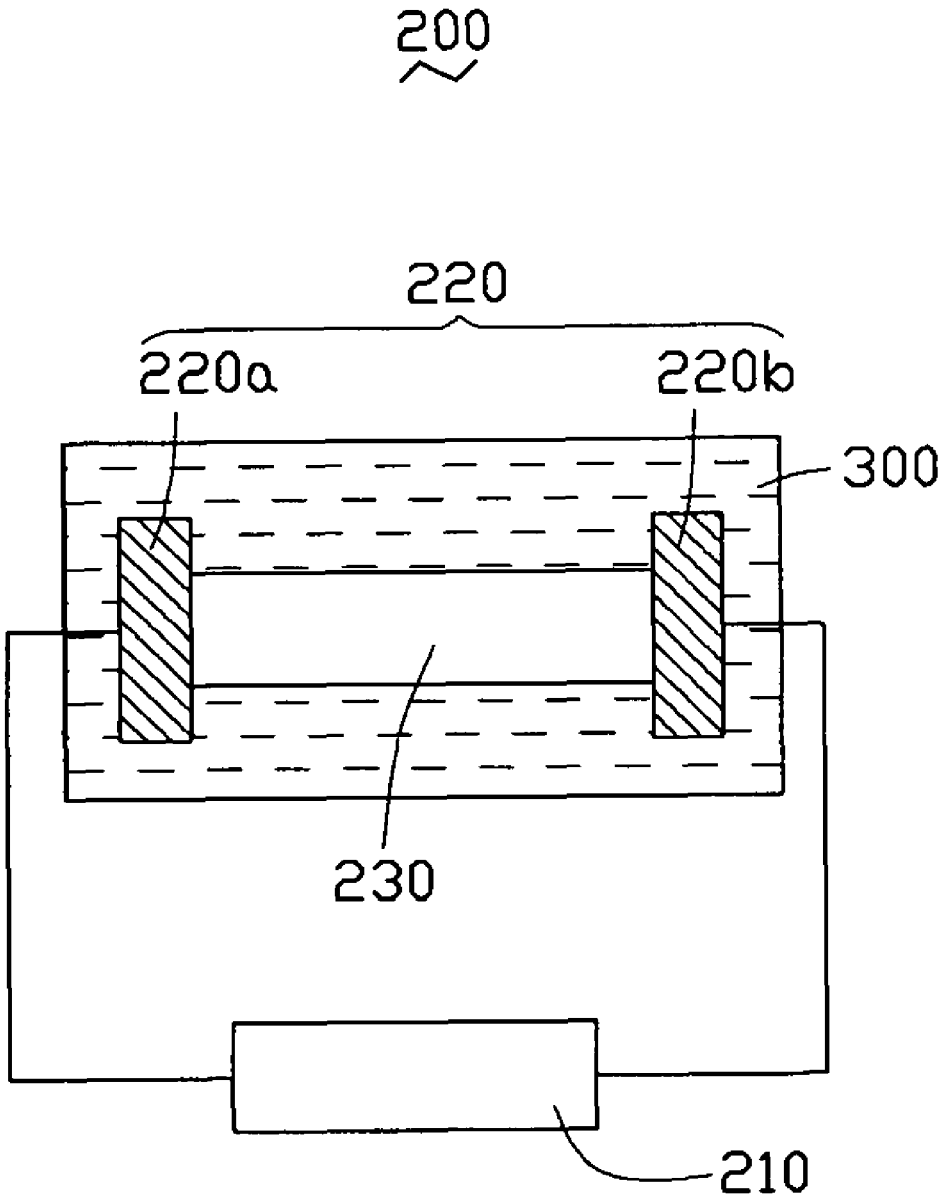
FIG. 1 is a schematic structural view of an embodiment of a thermoacoustic device.

Referring to FIG. 1, a thermoacoustic device 200 according to a first embodiment includes a signal device 210, at least two electrodes 220, and a sound wave generator 230. The at least two electrodes 220 are located apart from each other, and are electrically connected to the sound wave generator 230. The signal device 210 is electrically connected to the sound wave generator 230 by the at least two electrodes 220. The sound wave generator 230 is at least partial in contact with a liquid medium 300 in use. In one embodiment, the sound wave generator 230 is totally submerged in the liquid medium 300.

The at least two electrodes 220 input electrical signal from the signal device 210 to the sound wave generator 230. The sound wave generator 230 produces heat according to the variation of the signal and/or signal strength and propagates the heat to the surrounding liquid medium 300. The heat of the liquid medium 300 causes thermal expansion and produces pressure waves in the surrounding liquid medium 300, resulting in sound wave generation.

The signal device 210 is electrically connected to the sound wave generator 230 by the at least two electrodes 220. The signal device 210 can include pulsating direct current signal devices, alternating current devices and/or electromagnetic wave signal devices (e.g., optical signal devices, lasers). The electrical signals input from the signal device 210 to the sound wave generator 230 can be, for example, electromagnetic waves (e.g., optical signals), electrical signals (e.g., alternating electrical current, pulsating direct current signals, signal devices and/or audio electrical signals) or combinations thereof. When employing electromagnetic wave signals, electrodes are optional.

In one embodiment, the at least two electrodes 220 includes a first electrode 220*a* and a second electrode 222*b*. The first electrode 220*a* and the second electrode 222*b* are made of conductive material. The shape of the first electrode 220*a* or the second electrode 222*b* is not limited and can be lamellar, rod, wire, or block among other shapes. A material of the first electrode 220*a* or the second electrode 222*b* can be metals, conductive adhesives, carbon nanotubes, or indium tin oxides among other materials. In one embodiment, the first electrode 220*a* and the second electrode 222*b* are rod-shaped metal electrodes. The sound wave generator 230 is electrically connected to the first electrode 220*a* and the second electrode 222*b*. The electrodes 220*a*, 222*b* can provide structural support for the sound wave generator 230. The first electrode 220*a* and the second electrode 222*b* can be electrically connected to two output terminals of the signal device 210 by a conductive wire to form a signal loop. It also can be understood that the first electrode 220*a* and the second electrode 222*b* are optional according to different signal devices 210, e.g., when the signals are electromagnetic wave or light, the signal device 210 can input signals to the sound wave generator 230 without the first electrode 220*a* and the second electrode 222*b*.

The sound wave generator 230 includes a carbon nanotube structure. The carbon nanotube structure can have many different structures and a large specific surface area. Thus, the carbon nanotube structure has a large surface area to contact the liquid medium 300. The carbon nanotube structure can have a heat capacity per unit area of less than $2\times10^{-4}$ J/cm2*K. In one embodiment, the carbon nanotube structure can have a heat capacity per unit area of less than or equal to about $1.7\times10^{-6}$ J/cm2*K. Some of the carbon nanotube structures have large specific surface area, and thus, some sound wave generators 230 can be adhered directly to the first electrode 220*a* and the second electrode 222*b* and/or many other surfaces. This will result in a good electrical contact between the sound wave generator 230 and the electrodes 220*a*, 222*b*. Optionally an adhesive can also be used.

The carbon nanotube structure can include a plurality of carbon nanotubes uniformly distributed therein, and the carbon nanotubes therein can be combined by van der Waals attractive force therebetween. The carbon nanotubes in the carbon nanotube structure can be arranged orderly or disorderly. The term 'disordered carbon nanotube structure' includes a structure where the carbon nanotubes are arranged along many different directions, arranged such that the number of carbon nanotubes arranged along each different direction can be almost the same (e.g. uniformly disordered); and/or entangled with each other. 'Ordered carbon nanotube structure' includes a structure where the carbon nanotubes are arranged in a consistently systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure can be selected from single-walled, double-walled, and/or multi-walled carbon nanotubes.

The carbon nanotube structure may have a substantially planar structure. The planar carbon nanotube structure can have a thickness of about 0.5 nanometers to about 1 millimeter. The smaller the heat capacity per unit area, the higher the sound pressure level of the thermoacoustic device 200.

The carbon nanotube structure may be a carbon nanotube film structure, a carbon nanotube linear structure or combinations thereof. The thickness of the carbon nanotube structure may range from about 0.5 nanometers to about 1 millimeter.

Figure 2:
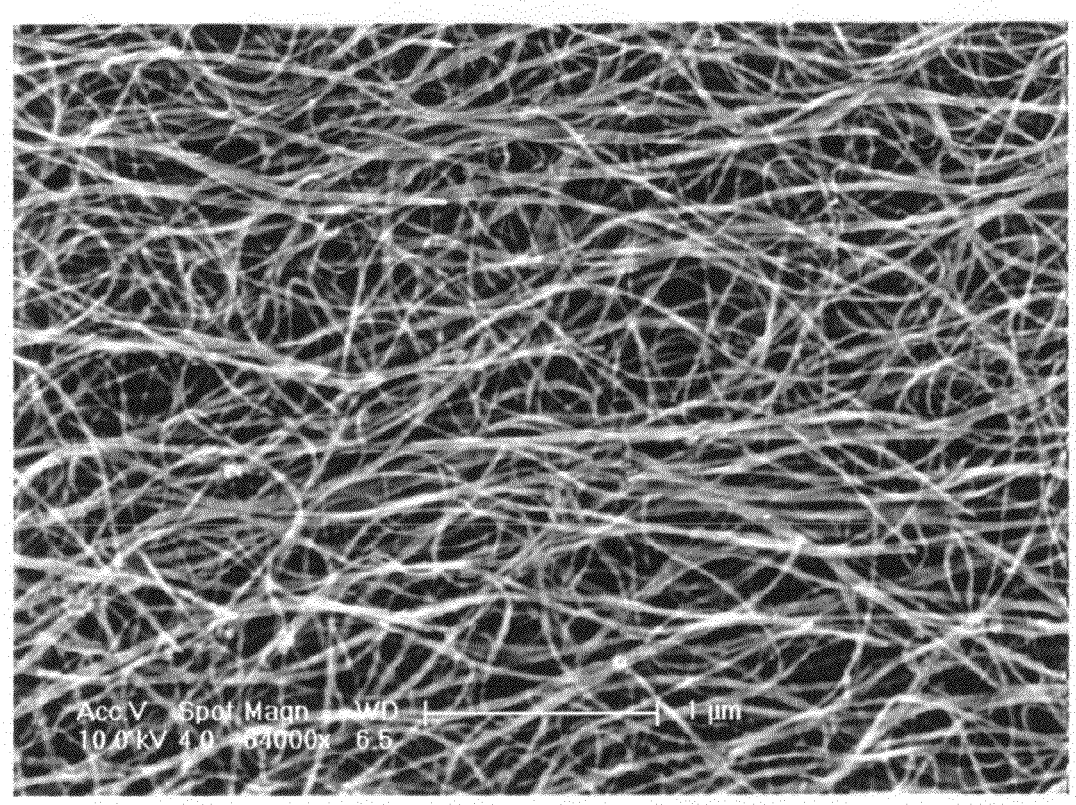
FIG. 2 shows a Scanning Electron Microscope (SEM) image of a flocculated carbon nanotube film.

In one embodiment, the carbon nanotube film structure can include a flocculated carbon nanotube film as shown in FIG. 2. The flocculated carbon nanotube film can include a plurality of long, curved, disordered carbon nanotubes entangled with each other. Further, the flocculated carbon nanotube film can be isotropic. The carbon nanotubes can be substantially uniformly dispersed in the carbon nanotube film. The adjacent carbon nanotubes are acted upon by the van der Waals attractive force therebetween, thereby forming an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure. Further, due to the carbon nanotubes in the carbon nanotube structure being entangled with each other, the carbon nanotube structure employing the flocculated carbon nanotube film has excellent durability, and can be fashioned into desired shapes with a low risk to the integrity of carbon nanotube structure. Thus, the sound wave generator 230 may be formed into many shapes. The flocculated carbon nanotube film, in some embodiments, will not require the use of structural support due to the carbon nanotubes being entangled and adhered together by van der Waals attractive force therebetween. The flocculated carbon nanotube film has a thickness of from about 0.5 nanometers to about 1 millimeter. It is also understood that many of the embodiments of the carbon nanotube structure are flexible and/or do not require the use of structural support to maintain their structural integrity.

Figure 3:
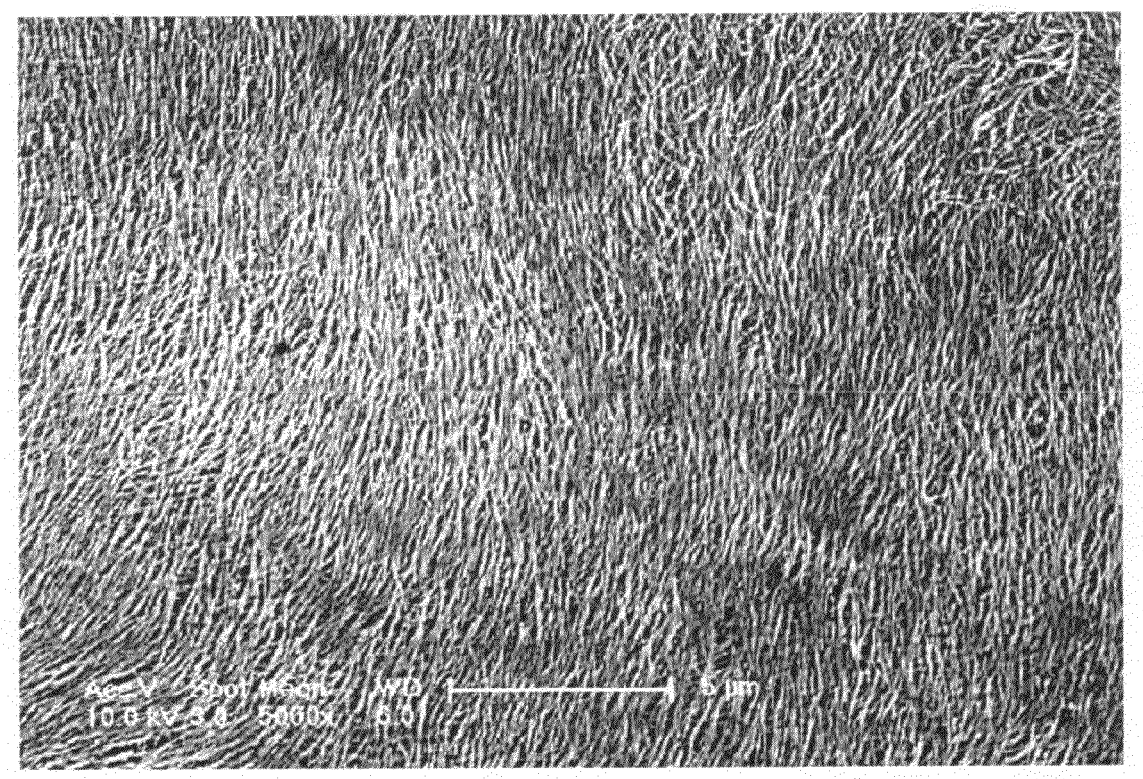
FIG. 3 shows an SEM image of a pressed carbon nanotube.
Figure 4:
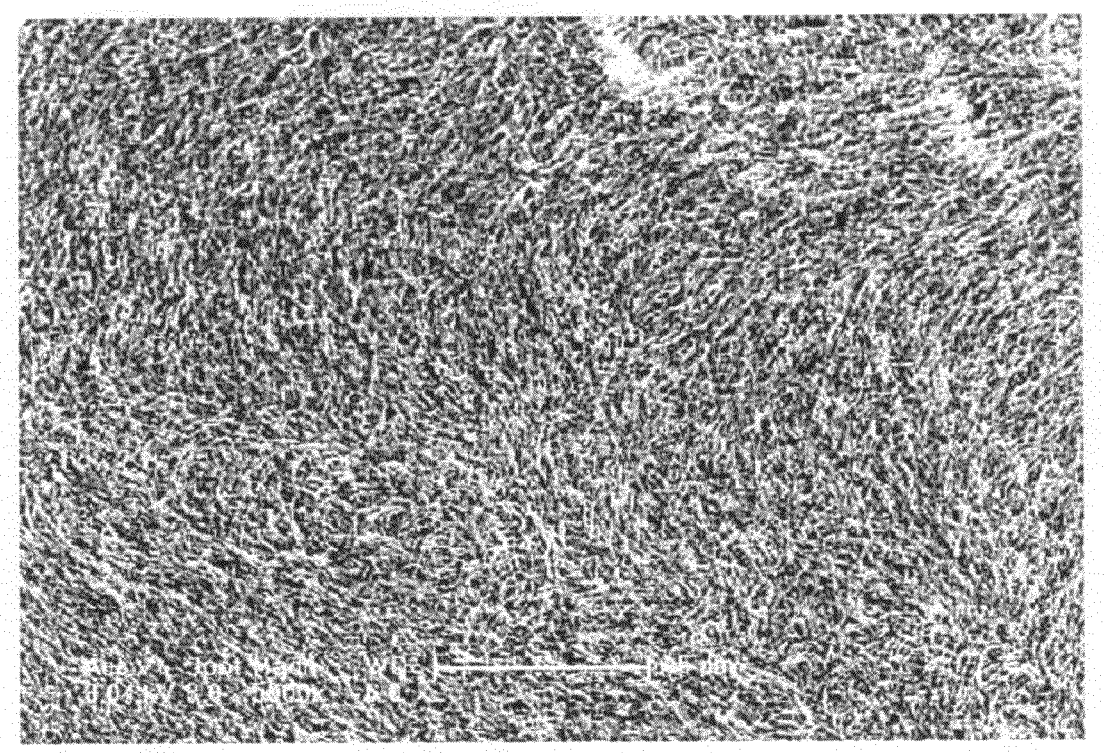
FIG. 4 shows an SEM image of a pressed carbon nanotube film with carbon nanotubes therein arranged along different orientations.

In one embodiment, the carbon nanotube film structure can comprise a pressed carbon nanotube as shown in FIG. 3 and FIG. 4. The carbon nanotubes in the pressed carbon nanotube film are arranged along a same direction or arranged along different directions. The carbon nanotubes in the pressed carbon nanotube film can rest upon each other. The adjacent carbon nanotubes are combined and attracted to each other by van der Waals attractive force, and can form a free-standing structure. An angle between a primary alignment direction of the carbon nanotubes and a surface of the pressed carbon nanotube film is in an approximate range from 0 degrees to approximately 15 degrees. The pressed carbon nanotube film can be formed by pressing a carbon nanotube array. The angle is closely related to pressure applied to the carbon nanotube array. The greater the pressure, the smaller the angle. The carbon nanotubes in the carbon nanotube film are parallel to the surface of the carbon nanotube film when the angle is 0 degrees. A length and a width of the carbon nanotube film can be set as desired. The pressed carbon nanotube film can include a plurality of carbon nanotubes aligned along one or more directions. The pressed carbon nanotube film can be obtained by pressing the carbon nanotube array with a pressure head. It is to be understood that the shape of the pressure head and the pressing direction can determine the direction of the carbon nanotubes arranged therein. Specifically, in one embodiment, when a planar pressure head is used to press the carbon nanotube array along the direction perpendicular to a substrate. A plurality of carbon nanotubes pressed by the planar pressure head may be sloped in many directions. In another embodiment, when a roller-shaped pressure head is used to press the carbon nanotube array along a certain direction, the pressed carbon nanotube film having a plurality of carbon nanotubes aligned along the certain direction is obtained. In another embodiment, when the roller-shaped pressure head is used to press the carbon nanotube array along different directions, the pressed carbon nanotube film having a plurality of carbon nanotubes aligned along different directions is obtained. The thickness of the pressed carbon nanotube film ranges from about 0.5 nanometers to about 1 millimeter. Examples of the pressed carbon nanotube film are taught in US application No. 20080299031A1 to Liu et al.

Figure 5:
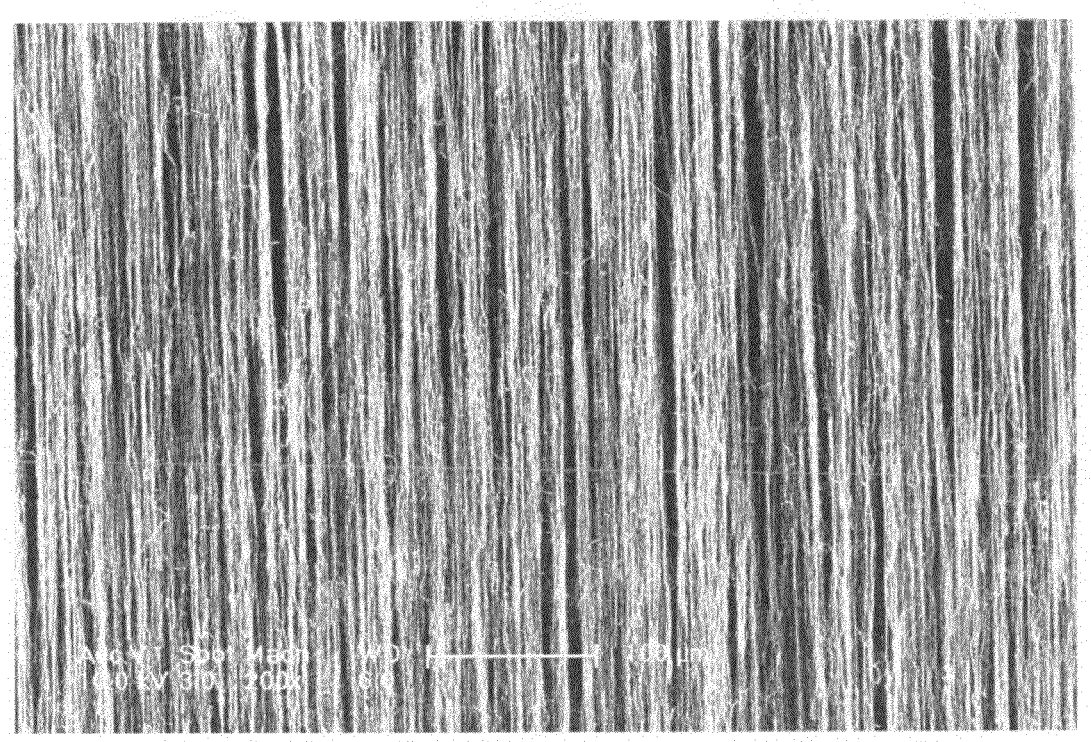
FIG. 5 shows an SEM image of a drawn carbon nanotube film.
Figure 6:
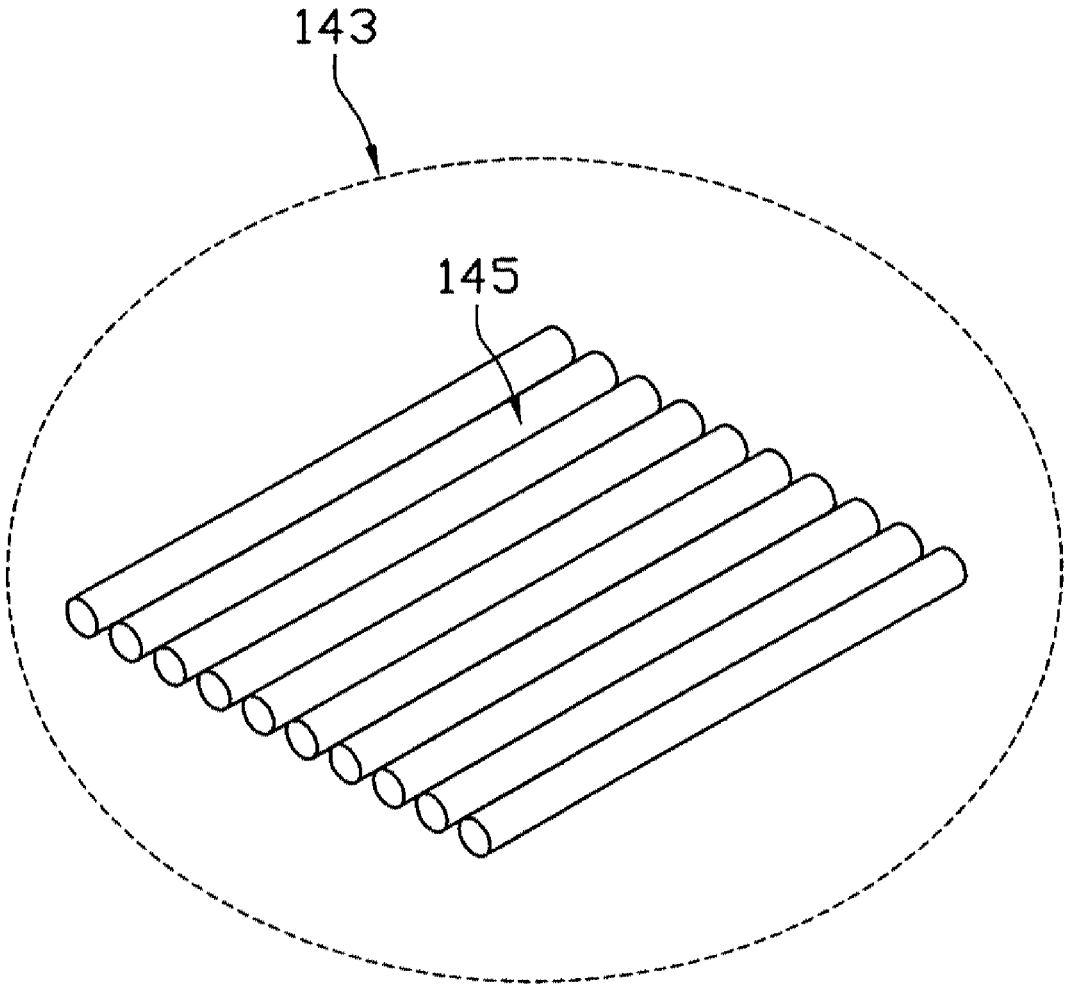
FIG. 6 is a schematic structural view of a carbon nanotube segment.

In one embodiment, the carbon nanotube film structure can include at least one drawn carbon nanotube film as shown in FIG. 5. The drawn carbon nanotube film can include a plurality of successive and oriented carbon nanotubes joined end-to-end by van der Waals attractive force therebetween. The carbon nanotubes in the drawn carbon nanotube film can be substantially aligned in a single direction. Referring to FIG. 6, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 6, some variations can occur in the drawn carbon nanotube film. The carbon nanotubes 145 in the drawn carbon nanotube film are also oriented along a preferred orientation. The drawn carbon nanotube film can be formed by drawing a film from a carbon nanotube array that is capable of having a film drawn therefrom.

In one embodiment, the carbon nanotube film structure of the sound wave generator 230 comprises a plurality of stacked drawn carbon nanotube films. The number of the layers of the drawn carbon nanotube films is not limited. However, a large enough specific surface area must be maintained to achieve an efficient thermoacoustic effect. The drawn carbon nanotube film has a thickness of about 0.5 nanometers to about 1 millimeter. An angle can exist between the carbon nanotubes in adjacent drawn carbon nanotube films. Adjacent drawn carbon nanotube films can be adhered by only the van der Waals attractive force therebetween. The angle between the aligned directions of the carbon nanotubes in the two adjacent drawn carbon nanotube films can range from 0 degrees to about 90 degrees. When the angle is larger than 0 degrees, the carbon nanotube film structure in an embodiment employing these films will have a plurality of micropores. The micropore structure will improve the structural integrity of the carbon nanotube film structure. When the carbon nanotube film structure is moved into the liquid medium from the gas, the micropore structure will make the carbon nanotube film structure more difficult to shrink under the surface tension of the liquid medium 300 if the carbon nanotube structure was allowed to dry. In one embodiment, the carbon nanotube film structure has 16 layers of the drawn carbon nanotube films, and the angle between the aligned directions of the carbon nanotubes in adjacent drawn carbon nanotube films is about 90 degrees.

It can be understood that when stacked drawn carbon nanotube films are few in number, for example, less than 16 layers, the sound wave generator 230 has greater transparency. Thus, it is possible to acquire a transparent thermoacoustic device 200 by employing the transparent sound wave generator 230. The transparent thermoacoustic device 200 can be located on a surface of many things to be submersed, such as a diving suit or submersible and so on.

In one embodiment, the carbon nanotube linear structure can include carbon nanotube wires and/or carbon nanotube cables.

Figure 7:
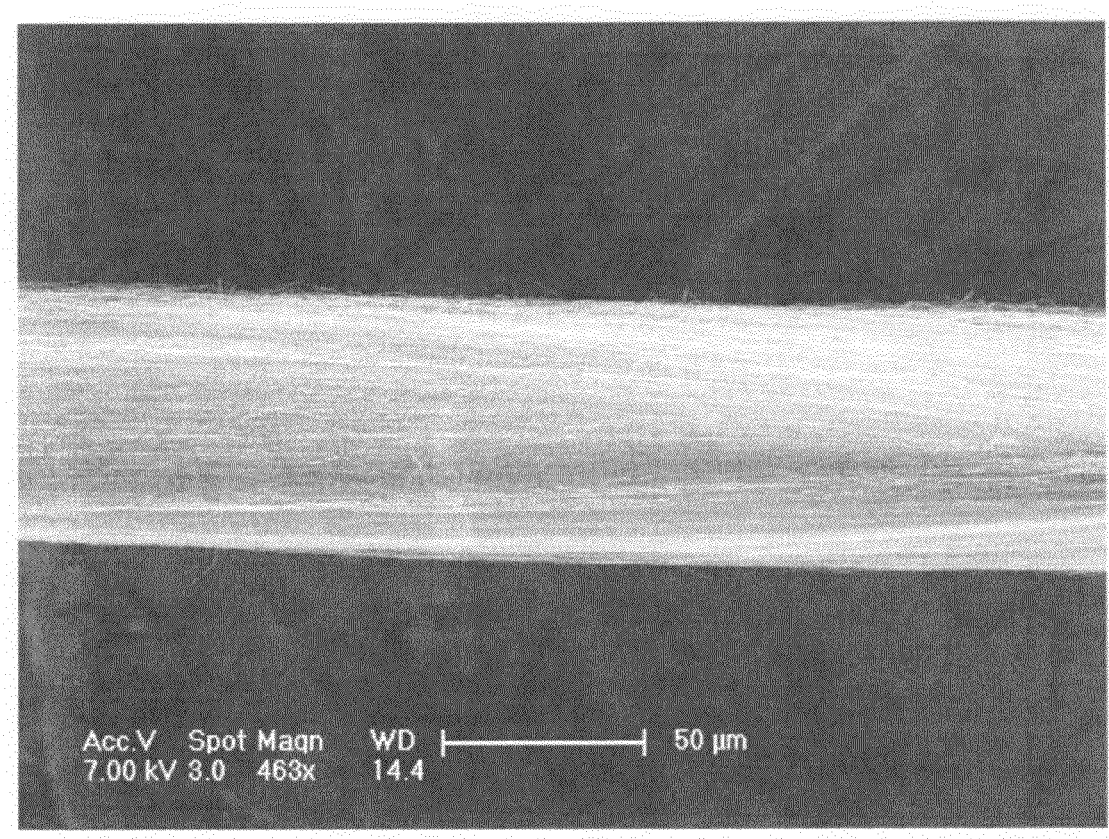
FIG. 7 shows an SEM image of an untwisted carbon nanotube.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. Referring to FIG. 7, the untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire ranges from about 0.5 nanometers to about 100 micrometers.

Figure 8:
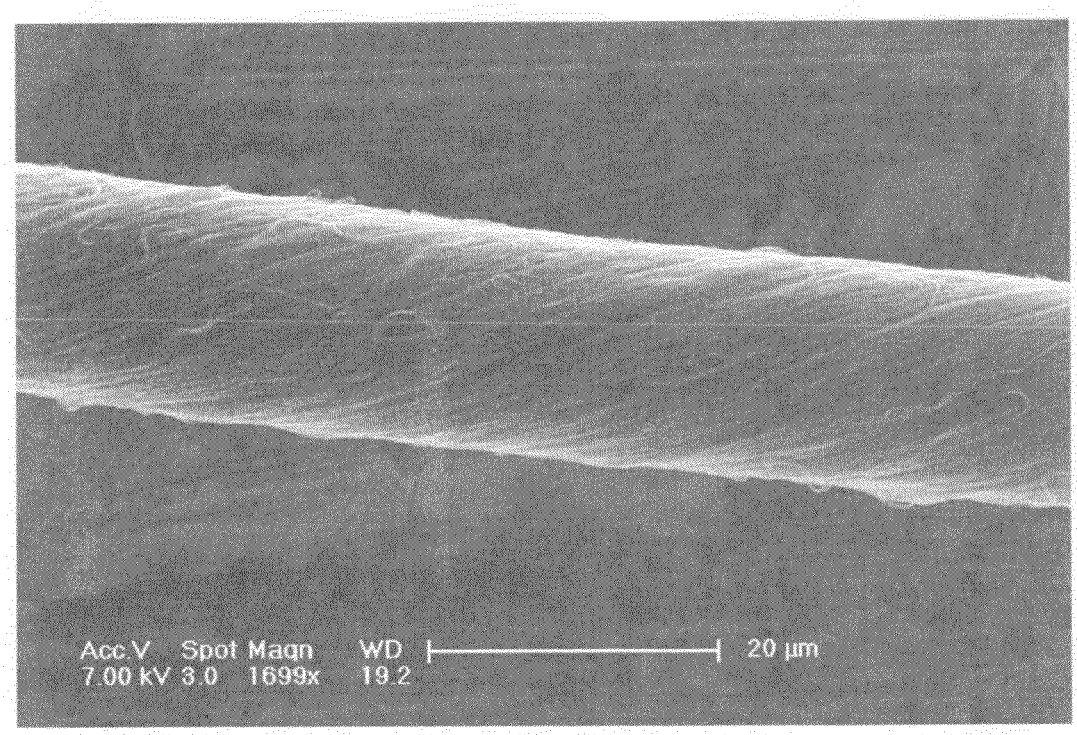
FIG. 8 shows an SEM image of a twisted carbon nanotube wire.

The twisted carbon nanotube wire can be formed by twisting a drawn carbon nanotube film using a mechanical force to turn the two ends of the drawn carbon nanotube film in opposite directions. Referring to FIG. 8, the twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes parallel to each other, and combined by van der Waals attractive force therebetween. Length of the carbon nanotube wire can be set as desired. A diameter of the twisted carbon nanotube wire can be from about 0.5 nanometers to about 100 micrometers. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease, while the density and strength of the twisted carbon nanotube wire will be increased.

The carbon nanotube cable includes two or more carbon nanotube wires. The carbon nanotube wires in the carbon nanotube cable can be, twisted or untwisted. In an untwisted carbon nanotube cable, the carbon nanotube wires are parallel with each other. In a twisted carbon nanotube cable, the carbon nanotube wires are twisted with each other.

In use, the sound wave generator 230 can be submerged in the liquid medium 300. When signals, e.g., electrical signals, with variations in the application of the signal and/or strength are applied to the carbon nanotube structure of the sound wave generator 230 from the signal device 210, heat is produced in the carbon nanotube structure of the sound wave generator 230. Temperature of the sound wave generator 230 will change rapidly, since the carbon nanotube structure of the thermoacoustic device 200 has a small heat capacity per unit area. For the reason that the carbon nanotube structure of the thermoacoustic device 200 has a large heat dissipation surface area, rapid thermal exchange can be achieved between the carbon nanotube structure and the surrounding liquid medium 300. Therefore, according to the variations of the electrical signals, heat waves are rapidly propagated in surrounding liquid medium 300. It is understood that the heat waves will cause thermal expansion and contraction, and change the density of the liquid medium 300. The heat waves produce pressure waves in the surrounding liquid medium 300, resulting in sound generation. In this process, it might be the thermal expansion and contraction of the liquid medium 300 or the gas adopted by the sound wave generator 14 in the vicinity of the sound wave generator 230 that produces sound.

The electrical resistivity of the liquid medium 300 should be higher than the resistance of the sound wave generator 230, e.g., higher than $1\times10^{-2}$ Ω*M, in order to maintain enough electro-heat conversion efficiency of the sound wave generator 230. The liquid medium 300 can be selected from the group consisting of nonelectrolyte solution, pure water, seawater, freshwater, organic solvents, and combinations thereof. In one embodiment, the liquid medium 300 is pure water with an electrical resistivity of about $1.5\times10^{7}$ Ω*M. It is understood that pure water has a relatively higher specific heat capacity to dissipate the heat of the sound wave generator 230 rapidly.

Figure 9:
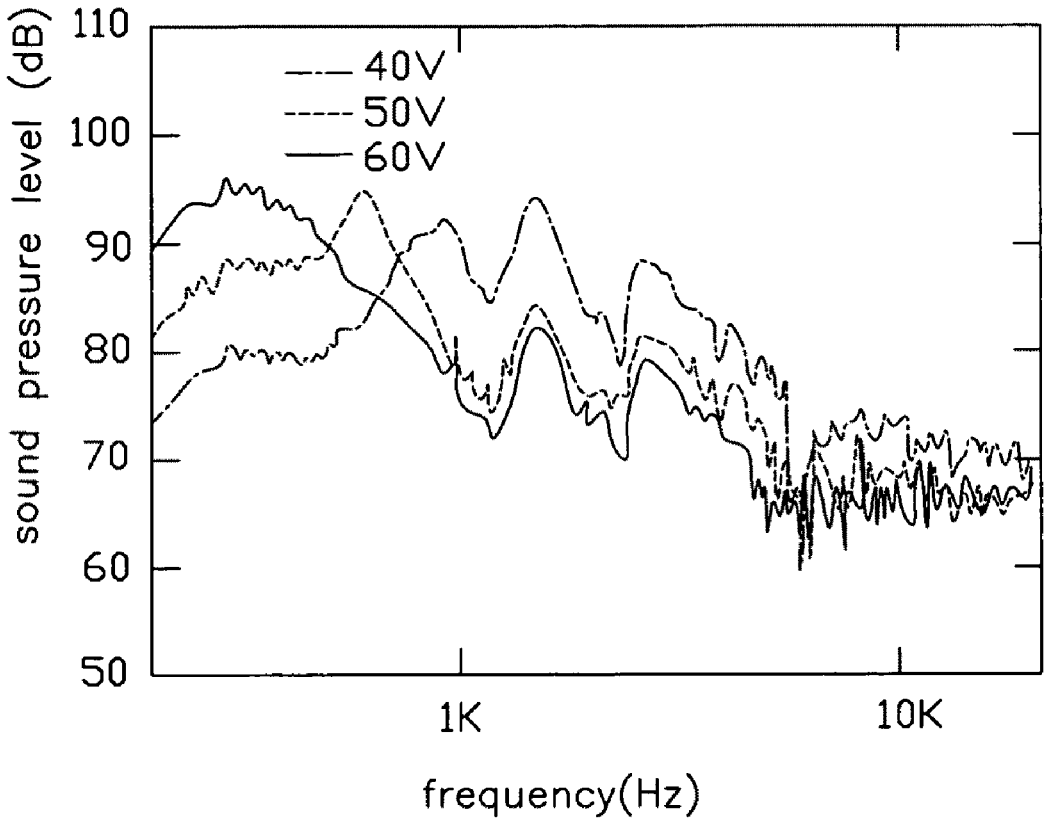
FIG. 9 is a frequency response curve of one embodiment of the thermoacoustic device.

FIG. 9 shows a frequency response curve of the thermoacoustic device 200 according an embodiment similar to the embodiment shown in FIG. 1. The sound wave generator 230 includes a carbon nanotube structure with 16 layers of the drawn carbon nanotube film, and the angle between the aligned directions of the carbon nanotubes in two adjacent drawn carbon nanotube films is about 0 degrees. The whole carbon nanotube structure is totally submerged in the pure water to a depth of about 0.1 centimeters. To obtain the frequency response curve of the thermoacoustic device 200, alternating currents of about 40 volts, then 50 volts, and then 60 volts are applied to the carbon nanotube structure respectively. A microphone is place above and near the surface of the pure water at a distance of about 5 centimeters from the sound wave generator 230. The microphone is used to measure the performance of the thermoacoustic device 200. As shown in FIG. 9, the thermoacoustic device 200 has a wide frequency response range and a high sound pressure level under water. The sound pressure level of the sound waves generated by the thermoacoustic device 200 can be up to 95 dB. The frequency response range of the thermoacoustic device 200 can be from about 1 Hz to about 100 KHz.

Figure 10:
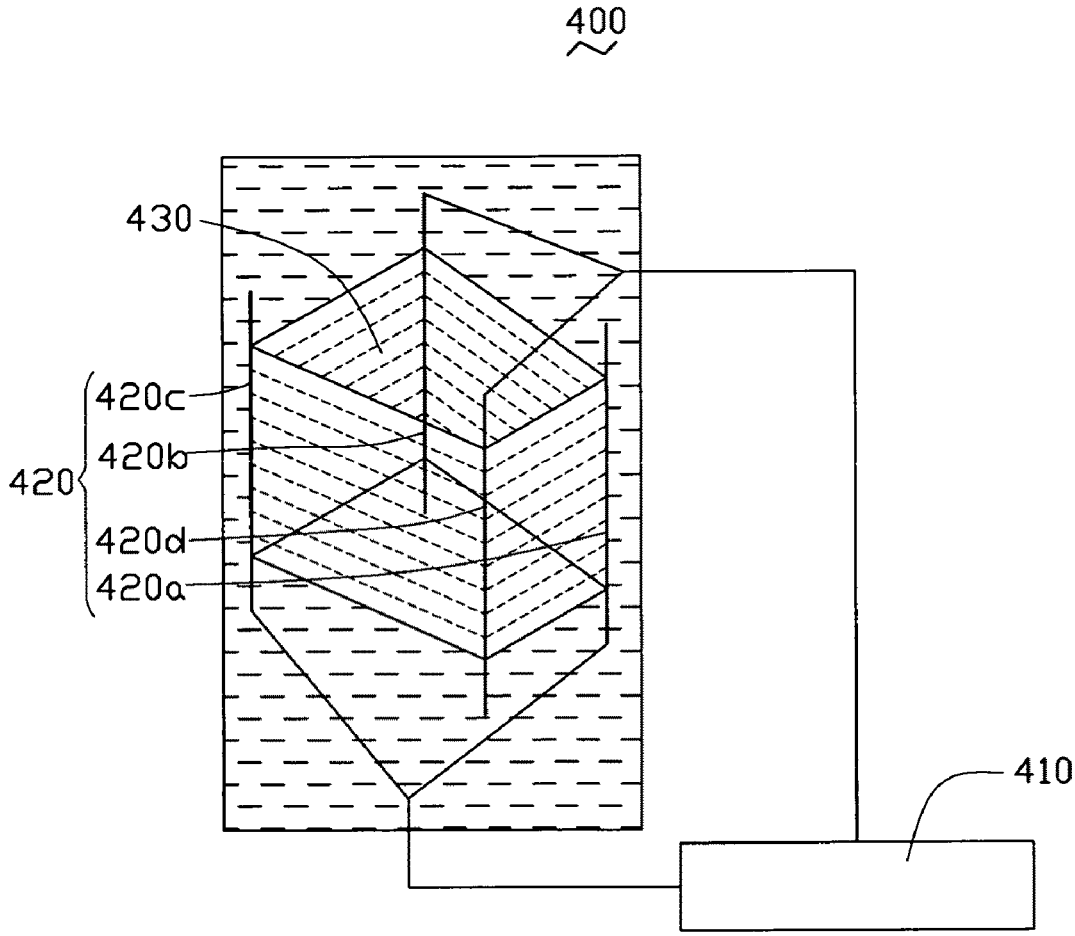
FIG. 10 is a schematic structural view of an embodiment of a thermoacoustic device.

Referring to FIG. 10, a thermoacoustic device 400, according to one embodiment is shown. It includes a signal device 410, four electrodes 420, and a sound wave generator 430. The four electrodes 420 include a first electrode 420*a*, a second electrode 420*b*, a third electrode 420*c*, and a fourth electrode 420*d*.

The composition, features, and functions of the thermoacoustic device 400 in the embodiment shown in FIG. 10 are similar to the thermoacoustic device 200 in the embodiment shown in FIG. 1. The difference is that the present thermoacoustic device 400 includes four electrodes 420. The first electrode 420*a*, the second electrode 420*b*, the third electrode 420*c*, and the fourth electrode 420*d* can be all rod-like metal electrodes, and are located apart from each other. The first electrode 420*a*, the second electrode 420*b*, the third electrode 420*c*, and the fourth electrode 420*d* can be in different planes. The sound wave generator 430 surrounds the first electrode 420*a*, the second electrode 420*b*, the third electrode 420*c*, and the fourth electrode 420*d* to form a three dimensional structure. As shown in the FIG. 10, the first electrode 420*a* and the third electrode 420*c* are electrically connected in parallel to one terminal of the signal device 410. The second electrode 420*b* and the fourth electrode 420*d* are electrically connected in parallel to the other terminal of the signal device 410. The parallel connections in the sound wave generator 430 provide lower resistance, so input voltage to the thermoacoustic device 400 can be lowered, thus the sound pressure of the thermoacoustic device 400 can be increased while maintain the same voltage. The sound wave generator 430, can radiate thermal energy to the surrounding liquid medium in, and thus create the sound wave. It is understood that the first electrode 420*a*, the second electrode 420*b*, the third electrode 420*c*, and the fourth electrode 420*d* can also be configured to and serve as a support for the sound wave generator 430.

In addition, it is to be understood that the first electrode 420*a*, the second electrode 420*b*, the third electrode 420*c*, and the fourth electrode 420*d* can be coplanar. The connections of the four coplanar electrodes 420 are similar to the connections in the embodiment shown in FIG. 10. Further, a plurality of electrodes 420, such as more than four electrodes 420, can be employed in the thermoacoustic device 400 according to needs following the same pattern of parallel connections as when four electrodes 420 are employed.

Figure 11:
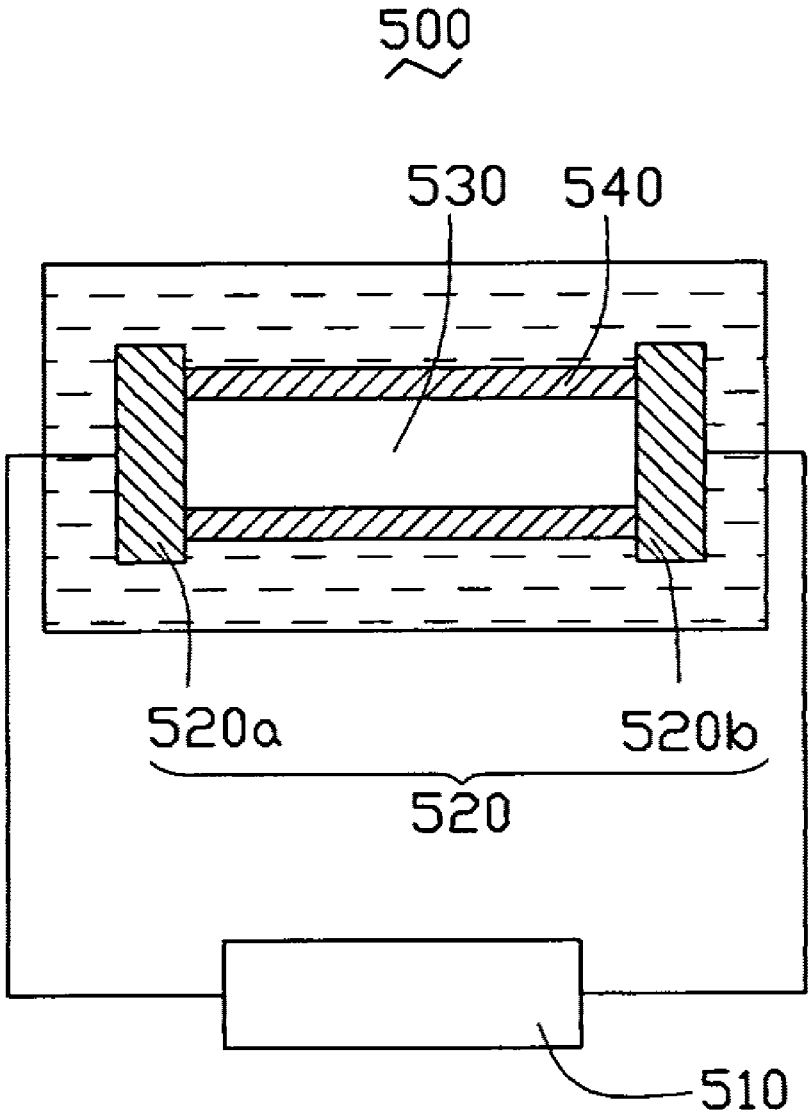
FIG. 11 is a schematic structural view of an embodiment of a thermoacoustic device employing a supporting element.

Referring to FIG. 11, a thermoacoustic device 500 according to one embodiment includes a signal device 510, two electrodes 520, and a sound wave generator 530. The two electrodes 520 include a first electrode 520*a* and a second 520*b*.

The composition, features, and functions of the thermoacoustic device 500 in the embodiment shown in FIG. 11 are similar to the thermoacoustic device 200 in the embodiment shown in FIG. 1 except that a supporting element 540 is employed.

The material of the supporting element 540 is not limited, and can be a rigid material, such as diamond, glass or quartz, or a flexible material, such as plastic, resin or fabric. The supporting element 540 can have a good thermal insulating property, thereby preventing the supporting element 540 from absorbing the heat generated by the sound wave generator 530. Furthermore, the supporting element 540 can have a relatively rough surface; whereby the sound wave generator 530 can have an increased contact area with the surrounding liquid medium.

The supporting element 540 is configured for supporting the sound wave generator 530. A shape of the supporting element 540 is not limited, nor is the shape of the sound wave generator 530. The supporting element 540 can have a planar and/or a curved surface. Since the carbon nanotube structure has a large specific surface area, and the sound wave generator 530 can be adhered directly on the supporting element 540. When signals with higher intensity be input to the sound wave generator 530 to achieve a higher sound pressure, a disturbance can be occur in the liquid medium. The supporting element 540 supporting the sound wave generator 530 can prevent the sound wave generator 530 from being damaged. In addition, the supporting element 540 can prevent the carbon nanotube structure of the sound wave generator 530 from being damaged or changed by surface tension when the carbon nanotube structure moves from the liquid medium to the gas medium.

In one embodiment, the supporting element 540 also may have a three dimensional structure, such as a cube, a cone, or a cylinder. Then, the sound wave generator 530 can surround the supporting element 540 and form a ring-shaped sound wave generator 530.

Figure 12:
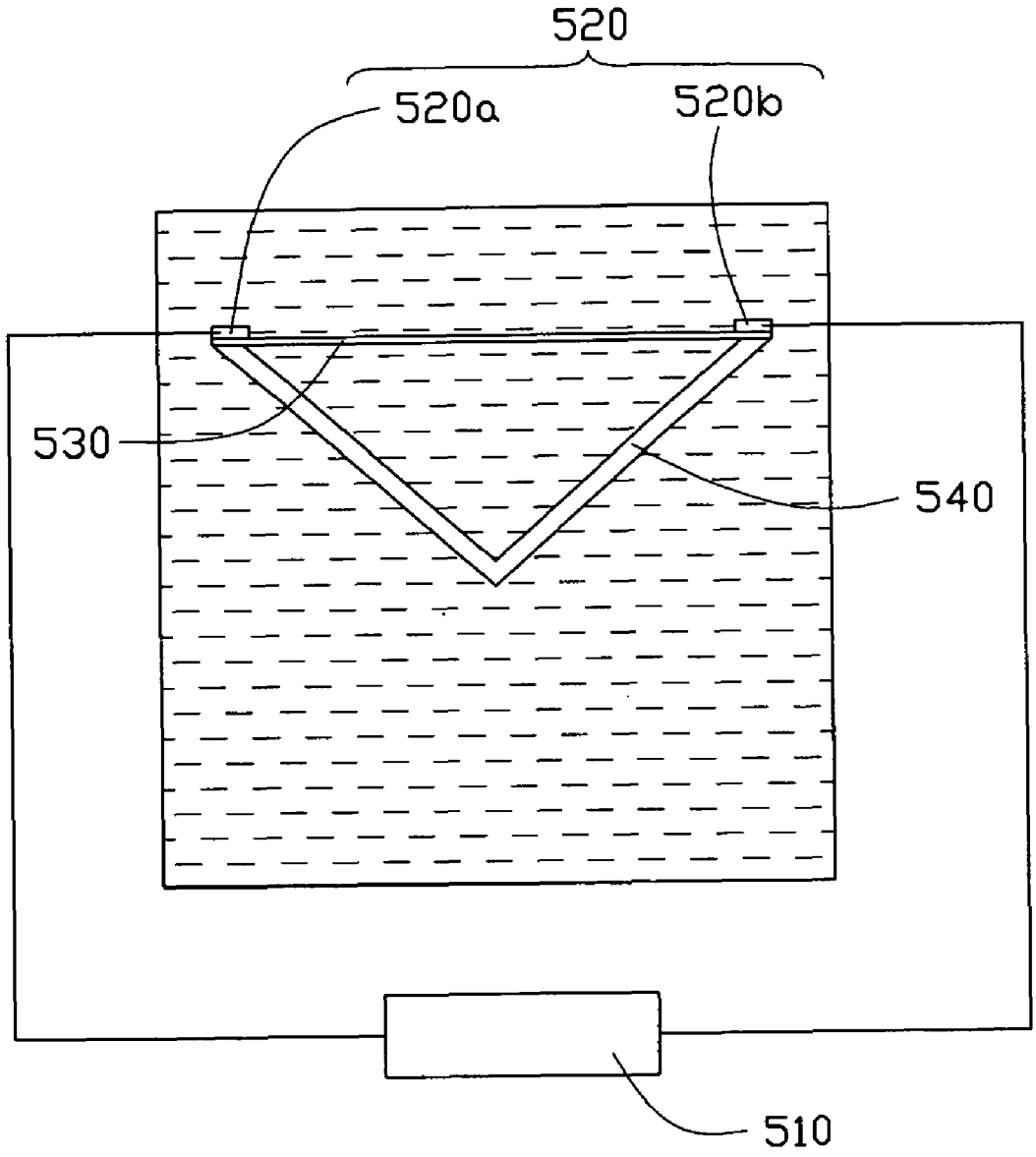
FIG. 12 is a schematic structural view of an embodiment of a thermoacoustic device employing a framing element
Figure 13:
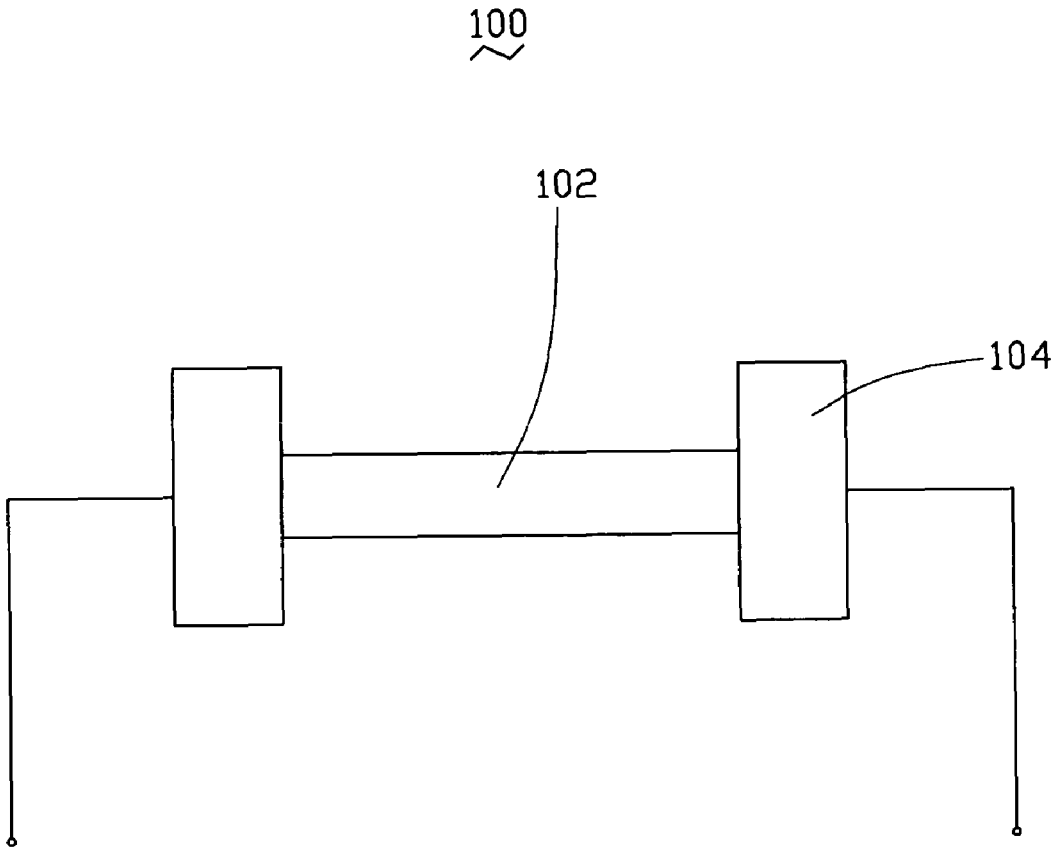
FIG. 13 (PRIOR ART)
FIG. 13 is a schematic structural view of a thermophone according to the related art.

In other embodiments as shown in FIG. 12, a framing element can be used. A portion of the sound wave generator 530 is located on a surface of the framing element and a sound collection space is defined by the sound wave generator 530 and the framing element. The sound collection space can be a closed space or an open space. In one embodiment, the framing element has an L-shaped structure. The framing element can also be a framing element with a V-shaped structure, or any cavity structure with an opening. The sound wave generator 530 can cover the opening of the framing element to form a Helmholtz resonator. Alternatively, the thermoacoustic device 500 also can have two or more framing elements, the two or more framing elements are used to collectively suspend the sound wave generator 530. A material of the framing element can be selected from suitable materials including wood, plastics, metal and glass. Referring to FIG. 12, the framing element includes a first portion connected at right angles to a second portion to form the L-shaped structure of the framing element. The sound wave generator 530 extends from the distal end of the first portion to the distal end of the second portion, resulting in a sound collection space defined by the sound wave generator 530 in cooperation with the L-shaped structure of the framing element. The first electrode 520*a* and the second electrode 520*b* are connected to a surface of the sound wave generator 530. Sound waves generated by the sound wave generator 530 can be reflected by the inside wall of the framing element, thereby enhancing acoustic performance of the thermoacoustic device 500. Alternatively, a framing element can take any shape so that carbon nanotube structure is suspended, even if no space is defined. In other embodiments, both a supporting element 540 and a framing element are employed.

The thermoacoustic device employs the carbon nanotube structure as the sound wave generator. The carbon nanotube structure includes a plurality of carbon nanotubes, and has a small heat capacity per unit area and a large specific surface area. The carbon nanotube structure can cause pressure oscillation in the surrounding liquid medium by the generation of heat waves. The thermoacoustic device has a wider frequency response range and a higher sound pressure. The sound waves generated by the thermoacoustic device can be audible to humans. Further, the thermoacoustic device can generate sound waves in a liquid medium. Therefore, the thermoacoustic device can be used in many fields.

Finally, it is to be understood that the above-described embodiments are intended to illustrate rather than limit the disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. A thermoacoustic device, comprising:

a signal device; and a sound wave generator, comprising a carbon nanotube structure, in contact with a liquid medium;

wherein when the signal device inputs signals to the carbon nanotube structure, the carbon nanotube structure is capable of converting the signals into heat; and the heat is transferred to the liquid medium and is capable of causing a thermoacoustic effect.

2. The thermoacoustic device of claim 1, wherein the carbon nanotube structure has a heat capacity per unit area of less than or equal to $2\times10^{-4}$ J/cm$^2$*K.

3. The thermoacoustic device of claim 1, wherein the carbon nanotube structure has a heat capacity per unit area of less than or equal to $1.7\times10^{-6}$ J/cm$^2$*K.

4. The thermoacoustic device of claim 1, wherein the liquid medium has an electrical resistivity of higher than or equal to $1\times10^{-2}$ Ω*M.

5. The thermoacoustic device of claim 4, wherein the liquid medium is selected from the group consisting of nonelectrolyte solution, pure water, seawater, freshwater organic solvent, and combinations thereof.

6. The thermoacoustic device of claim 4, wherein the liquid medium comprises of a pure water with an electrical resistivity of 1.5×107 Ω*M.

7. The thermoacoustic device of claim 1, wherein the carbon nanotube structure is at least partial in contact with the liquid medium.

8. The thermoacoustic device of claim 1, wherein at least a surface of the carbon nanotube structure is in contact with the liquid medium.

9. The thermoacoustic device of claim 1, wherein the carbon nanotube structure is totally submerged in the liquid medium.

10. The thermoacoustic device of claim 1, wherein the carbon nanotube structure comprises of at least one carbon nanotube film, at least one carbon nanotube wire structure, or both at least one carbon nanotube film and at least one carbon nanotube wire structure.

11. The thermoacoustic device of claim 10, wherein the carbon nanotube film comprises a plurality of carbon nanotubes disorderly arranged therein.

12. The thermoacoustic device of claim 11, wherein the carbon nanotube film is isotropic and the carbon nanotubes therein are entangled with each other.

13. The thermoacoustic device of claim 10, wherein the carbon nanotube film comprises a plurality of carbon nanotubes orderly arranged therein.

14. The thermoacoustic device of claim 13, wherein the carbon nanotubes are joined end to end by the van der Waals attractive force therebetween.

15. The thermoacoustic device of claim 1, wherein the carbon nanotube structure comprises a plurality of stacked carbon nanotube films.

16. The thermoacoustic device of claim 1, wherein the carbon nanotube structure has a substantially planar structure, and a thickness of the carbon nanotube structure ranges from about 0.5 nanometers to about 1 millimeter.

17. The thermoacoustic device of claim 1, wherein the sound wave generator is capable of propagating a sound wave with a sound pressure level greater than 60 dB.

18. The thermoacoustic device of claim 1, wherein the frequency response range of the sound wave generator ranges from about 1 Hz to about 100 KHz.

19. The thermoacoustic device of claim 1, wherein the signals from the signal device are selected from a group consisting of electromagnetic waves, pulsating direct current, alternating current, and combinations thereof.

20. The thermoacoustic device of claim 1, further comprising at least two electrodes, the signal device coupled to the carbon nanotube structure by the at least two electrodes.

21. The thermoacoustic device of claim 1, further comprising four electrodes, the sound wave generator forms a three dimensional structure, the four electrodes include a first electrode, a second electrode, a third electrode, and a fourth electrode, the first electrode and the third electrode are electrically connected in parallel to one terminal of the signal device, the second electrode and the fourth electrode are electrically connected in parallel to the other terminal of the signal device.

22. A thermoacoustic device, the thermoacoustic device comprises of:

a signal device;

a carbon nanotube structure in contact with a liquid medium;

wherein the carbon nanotube structure is capable of receiving a signal from the signal device; the carbon nanotube structure is capable of converting the signal to heat and transferring the heat to the liquid medium; and the liquid medium creates sound waves by a thermal expansion.

23. The thermoacoustic device of claim 22, wherein the carbon nanotube structure comprises at least one drawn carbon nanotube film.

24. The thermoacoustic device of claim 22, wherein the carbon nanotube structure comprises 16 stacked drawn carbon nanotube films, adjacent drawn carbon nanotube films is combined only by the van der Waals attractive force therebetween.

25. The thermoacoustic device of claim 22, wherein the medium comprises of substantially pure water and the carbon nanotube structure is totally submerged in the medium.

26. The thermoacoustic device of claim 22, wherein the sound wave generator is capable of propagating a sound wave with a sound pressure level greater than 60 dB.

27. The thermoacoustic device of claim 22, wherein the sound wave generator is capable of propagating a sound wave with a sound pressure level greater than 95 dB.

28. The thermoacoustic device of claim 22, wherein the sound wave generator is capable of propagating a sound wave with a frequency response from about 1 Hz to about 100 KHz.

29. A thermoacoustic device comprising:

a carbon nanotube structure; wherein the carbon nanotube structure produces sound waves in a liquid medium by causing a thermoacoustic effect, the carbon nanotube structure is a drawn carbon nanotube film comprising a plurality of carbon nanotubes joined end to end by the van der Waals attractive force therebetween.

* * * * *